United States Patent [19]

Brewer

[11] 4,176,478

[45] Dec. 4, 1979

[54] CALENDAR

[76] Inventor: Marie-Louise Brewer, 5203 Gaston Ave., Apt. 108, Dallas, Tex. 75214

[21] Appl. No.: 923,964

[22] Filed: Jul. 12, 1978

[51] Int. Cl.[2] ..... G09D 3/00

[52] U.S. Cl. ..... 40/107; 35/7 A; 40/621

[58] Field of Search ..... 40/107, 110, 120, 621, 40/600; 35/7 A

[56] References Cited

U.S. PATENT DOCUMENTS

| | | | |
|---|---|---|---|
| 554,837 | 2/1896 | Seibert | 40/107 |
| 684,107 | 10/1901 | Rueger | 40/107 |
| 1,343,601 | 6/1920 | White | 40/107 |
| 3,010,228 | 11/1961 | Torre | 35/7 A X |
| 3,579,882 | 5/1971 | Miyahune | 40/107 |
| 3,864,859 | 2/1975 | Kaufman | 40/107 |

*Primary Examiner*—John F. Pitrelli
*Attorney, Agent, or Firm*—Gerald G. Crutsinger

[57] ABSTRACT

A calendar having detachable components for perpetually arranging the calendar. The removable components are secured by a strip of magnetic tape secured to the rear portion which is attracted to ferris metal tacks secured on a board to hold the calendar components. The extra components are stored in a storage compartment behind the board.

4 Claims, 4 Drawing Figures

CALENDAR

BACKGROUND

It is desirable to have a calendar which is capable of being modified to perpetually exist thus saving the cost of renewing calendars. Heretofore, various calendars have been constructed of plastic materials which are easily broken and which become unuseable. Further attempts of perpetual calendars have generally had rollers which had a series of months and years printed on a cylinder which may be independently rotated to display the month, date and year, however, this type of calendar is limited to the space on the cylinder and does not show a entire month in one glance to allow planning forward in the month.

U.S. Pat. Nos. 1,635,927; 2,401,162; 2,447,807; 3,473,249; 3,564,741; and 3,579,882 disclose various types of calendars having removeable parts as described above.

SUMMARY

I have devised a calendar comprising a main body having a first flat surface divided into segmented parts and a second surface having a hollow portion to form a storage compartment. A door is hingedly secured to one side of the hollow back pivotally secured over the hollow storage compartment having lock means to latch the door in place. Each of the segmented portions on the flat front side has a pair of tacks having ferris metal formed therein secured in spaced relationship within each of the compartments.

A plurality of strips of material having a magnetic tape secured to the rear portion thereof are provided having indicia indicating the month thereon. The storage compartment has a plurality of spaced tacks formed therein for storage of the strips when not in use. A plurality of numerals are formed on short rectangular strips to indicate the day of the month with extra days being stored in the rear compartment. A plurality of numerals are stored in the rear compartment or displayed on the front face to indicate the year.

A primary object of the invention is to provide a perpetual calendar which may be changed from month to month, from year to year to eliminate the necessity of having to acquire a new calendar each year.

A still further object of the invention is to provide a calendar wherein the components of the calendar are self-storing in the rear of the calendar to eliminate waste and loss of the various components.

A still further object of the invention is to provide magnetically attracting components which will not wear out or have attachment lugs which break off.

Other and further objects of the invention will become apparent upon studying the attached specification and drawings annexed hereto.

BRIEF DESCRIPTION OF THE DRAWINGS

A drawing of the preferred embodiment of the invention is annexed hereto so that the invention may be better and more fully understood, in which.

Numeral references are used to designate like parts throughout the various figures of the drawing and the like numerals are used to designate like parts throughout.

DESCRIPTION OF A PREFERRED EMBODIMENT

Figure 1:
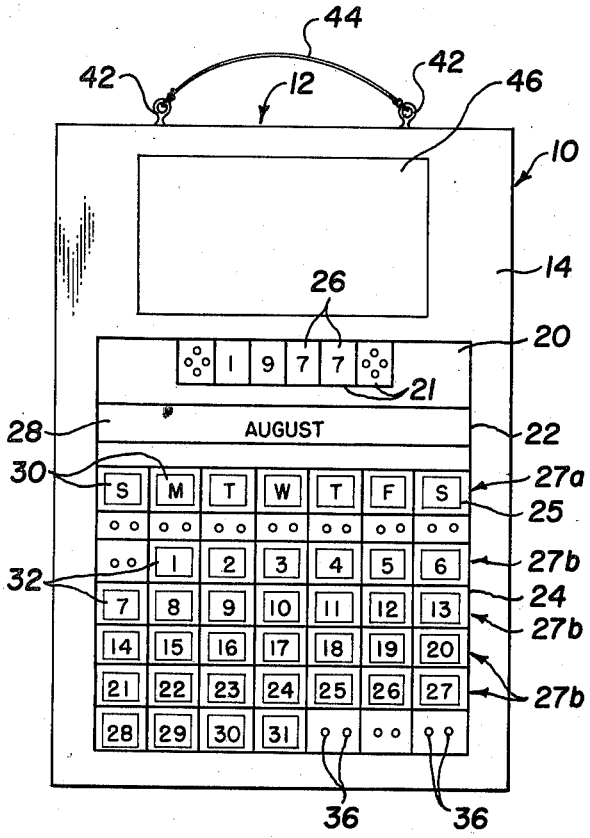
FIG. 1 is a front elevational view of the calendar.
Figure 2:
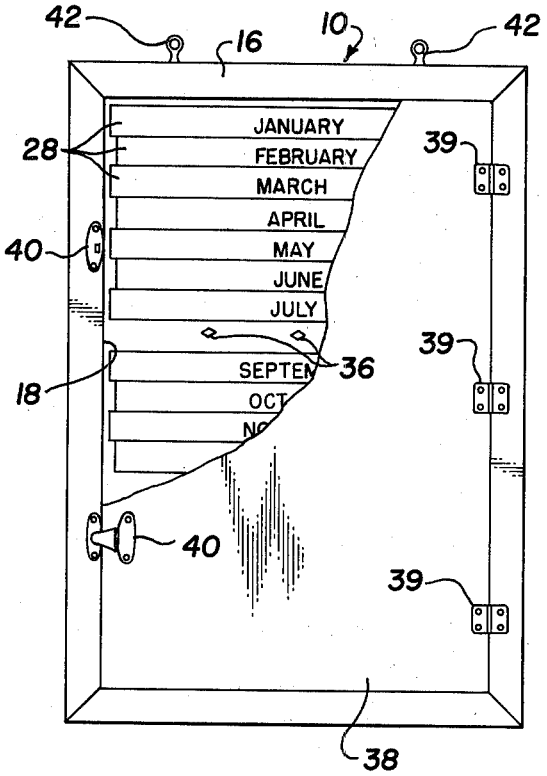
FIG. 2 is a rear elevational view thereof with parts broken away to more clearly illustrate the details of construction.
Figure 3:
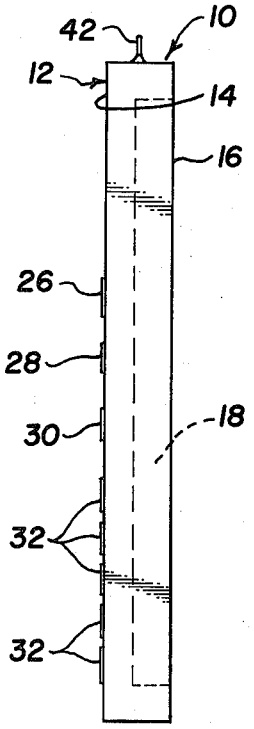
FIG. 3 is a right side elevational view thereof.
Figure 4:
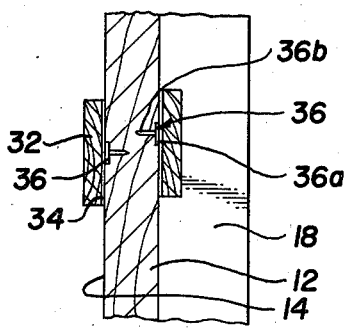
FIG. 4 is an enlarged cross-sectional view showing the means of attaching a strip on the face of the calendar and in the storage compartment.

Referring to the drawings, numeral 10 generally designates the calendar comprising a body 12 having a front portion 14 and rear portion 16 having a hollow compartment 18 formed therein. The front portion 14 generally comprises a planar surface having a plurality of lines formed thereon for dividing the front surface 14 into a plurality of segments. The first segment 20 has a plurality of sections 21 for indicating the year, the second segment 22 having a single section for indicating the month, and the third segment 24 having a plurality of rectangular sections for indicating the day of the week and month.

Segment 23 is divided into seven vertical rows for each day of the week and a single horizontal row **27*a* for days of the week and five horizontal rows 27*b* for the number of days of the month. A plurality of rectangular shaped blocks 26 are provided having indicia indicating the numerals 0 to 9 for display of the year within sections 21**.

A dozen elongated strips 28 are formed having indica indicating the month of the year and are positioned on surface 14 of end segment 22. Rectangular blocks 30 having indicia to indicate the day of the week formed thereon and are positioned in the first row segments 25 in the third segment 24 of the calendar. A plurality of rectangular blocks 32 are formed having indicia to indicate the days of the month one to thirty-one and are positioned in the appropriate order below the day of the week in segments 25 of the third segment 24.

Means to secure blocks 26, 28, 30 and 32 to the surface 14 of body 12 generally comprises a strip of magnetic tape 34 secured to the rear of each of the blocks. The tape 34 is self-adhering having a single adhesive side and sold under the tradename M.G.O. Magnetic Multiple Pull Tape.

A pair of tacks 36 are secured in each of the segments 25 of third section 24 and in section 22 and in each of the quadrants 21 of first section 20. Each of the tacks 36 has a head **36*a* and a spike 36*b* and are driven into the surface 14 of calendar 10. The tape 34 is attracted to the ferris metal within the tacks 36 and holds each of the blocks 26, 28, 30, or 32** to the appropriate location.

A plurality of tacks 36 are secured in spaced lines on the rear portion 16 of the calendar 10 within compartment 18. This provides storage for the extra elongated strips 28 for the months and the extra numerals 26 for the year and for extra days 32 of the month if the month has less than 31 days.

The tacks 36 may be similar to those used on picture frames. The diamond head tacks may be glued on if desired.

A closure member 38 is secured by hinges 39 over compartment 18. Latches 40 secure the closure member 38 in a closed position. Compartment 18 provides a storage compartment for the extra months and numerals which are not used.

Means to support the calendar 10 generally comprises hooks 42 which may be secured to a flexible rope 44 to hang the calendar 10 on the wall. A blank location 46 is provided for allowing a person to attach decorative art for decorating the calendar 10.

It should be readily apparent from the foregoing that each year the numerals 26 may be arranged to indicate the new year and the months 28 may be changed for the appropriate month and the numeral 32 may be changed to indicate the appropriate arrangement of days within the appropriate month.

The calendar 10 is preferably constructed of wood; however, other materials could be used.

It should be readily apparent that the invention hereinbefore discussed accomplishes the objects of the invention hereinbefore described.

Having described my invention, I claim:

1. A calendar for perpetually displaying the months and years comprising: a body having a flat planar front surface and a cavity formed in the rear surface, said front planar surface having a plurality of lines dividing the front surface into segments for displaying the year, the month, and the days of the month; a plurality of rectangular strips having numeral indicia printed thereon for indicating the year; a plurality of elongated strips having indicia printed thereon for indicating the month; a plurality of strips having indicia indicating the day of the week; strips having indicia printed thereon for indicating the numerical day of the month; tacks having ferris metal therein secured within each of the segments on the planar surface of the body; tacks secured in horizontal lines in spaced relationship in the hollow cavity of the body; magnetic tape secured to the rear portion of each of the strips adapted to be attracted to the tacks on the front surface of the body and the hollow cavity of the body so as to secure the appropriate strip in the appropriate segment; and closure means pivotally secured to the rear portion of the calendar.

2. The combination called for in claim 1 with the addition of: a latch to close said closure means; and hinges to pivotally secure said closure means to said body.

3. The combination called for in claim 1 with the addition of: hooks to hang the calendar on a surface.

4. The combination called for in claim 1 wherein the segments on the front surface of the body comprise: a first segment having sections for displaying the year; a second segment for displaying the month; and a third segment having seven vertical rows and a first single horizontal row to display the day of the week and five additional horizontal rows under the first horizontal row to display the days of the month.

* * * * *